US006568108B2

(12) United States Patent
Lin

(10) Patent No.: US 6,568,108 B2
(45) Date of Patent: May 27, 2003

(54) LIQUID DECORATION CONTAINER

(76) Inventor: Yung Chang Lin, No. 10, Lane 105, Pao Tsing Street, Taipei (TW)

( * ) Notice: Subject to any disclaimer, the term of this patent is extended or adjusted under 35 U.S.C. 154(b) by 49 days.

(21) Appl. No.: 09/878,279

(22) Filed: Jun. 12, 2001

(65) Prior Publication Data

US 2002/0170214 A1 Nov. 21, 2002

(30) Foreign Application Priority Data

May 18, 2001 (TW) ..... 90208174 U

(51) Int. Cl.[7] ..... G09F 19/00
(52) U.S. Cl. ..... 40/409; 40/410; 40/406
(58) Field of Search ..... 40/406, 409, 410

(56) References Cited

U.S. PATENT DOCUMENTS 2,435,612 A * 2/1948 Snyder ..... 40/406
5,442,869 A * 8/1995 McDarren et al. ..... 40/410
6,027,774 A * 2/2000 Fine et al. ..... 40/406

* cited by examiner

*Primary Examiner*—Cassandra H. Davis
(74) *Attorney, Agent, or Firm*—Troxell Law Office PLLC

(57) ABSTRACT

A liquid decoration container comprises an exhibition part, and a fitting part. The exhibition part is formed by way of blowing a hollow blank to constitute a hollow casing with a desirable shape and the hollow casing extends downward a cylindrical casing with an outer thread section. The fitting part is a base with an upper opening corresponding to the cylindrical casing and the upper opening provides an inner thread section. A ring plate is arranged to extend inward from an inner wall under the upper opening in the fitting part. The liquid is filled in the exhibition part and a doll is selectively fixed to or arranged on the ring plate. The cylindrical casing can engage with the upper opening by way of the outer thread section fastening to the inner thread section and a tight sealing can be performed as soon as a lower rim of the cylindrical casing touches the ring plate.

17 Claims, 7 Drawing Sheets

V-V

LIQUID DECORATION CONTAINER

BACKGROUND OF THE INVENTION

1. Field of The Invention

The present invention relates to a liquid decoration container, and particularly to an improved liquid decoration container, which is possible to be assembled simply, not possible to break caused by falling, provides an effect of tight sealing without liquid leakage.

2. Description of Related Art

A conventional liquid decoration container, such as a water ball decoration, can be used as a paperweight or an adornment. Even more, it is possible for us to play the liquid decoration container and enjoy the interaction between the metal pieces or snowflake like grains and the doll so that playing liquid decoration container is a very good way for the modern people to relieve their pressure.

The conventional liquid decoration container basically has a hollow glass ball with a lower opening and a plug (rubber plug) blocks the lower opening to constitute an enclosed container. However, the preceding structure of the conventional liquid decoration container is involved in a shortcoming that glass ball is fragile such that it is not possible to assure the safety. Besides, due to incomplete control of manufacturing process (such as the step of vacuum suction) or the material or the doll having the phenomenon of expansion caused by the heat and contraction caused by the cold, it may generate air bubbles in the container normally and the air bubbles are unable to be removed. The air bubbles staying in the container not only affect the pleasing outer look but also result in defection.

Another conventional liquid decoration container primarily has a pair of upper and lower hollow casing butting to each other, and the upper and the lower casings are welded together by way of supersonic wave with an injection hole reserved on the closed casing for filling the liquid. However, the structure of the second conventional liquid decoration container also has a shortcoming that a steel mold is applied to perform an injection molding for the container. Hence, the shape of the container is limited by the steel mold. Moreover, in order to keep the exhibition area transparent, the material mostly is acrylic, which is fragile. In addition, a clear welded line left after joining the upper and the lower casings together makes the consumers dislike it. Also, the casing is formed by way of injection molding so that the wall thereof has a considerable thickness, which makes the casing hard without elasticity. Similarly, air bubbles generating in the casing are not possible to be removed.

Besides, a doll used in the two liquid decoration containers mentioned above is made of plastics, polymer resin, or ceramics without changeability such that the doll may lose its freshness after being played a period of time. The principal reason why the user may lose his interest to the liquid decoration container with the doll made of preceding material resides in that the doll is unable to interact with the user.

SUMMARY OF THE INVENTION

An object of the present invention is to provide a liquid decoration container, which is possible to be assembled simply, not possible to break caused by falling, provides an effect of tight sealing without liquid leakage.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
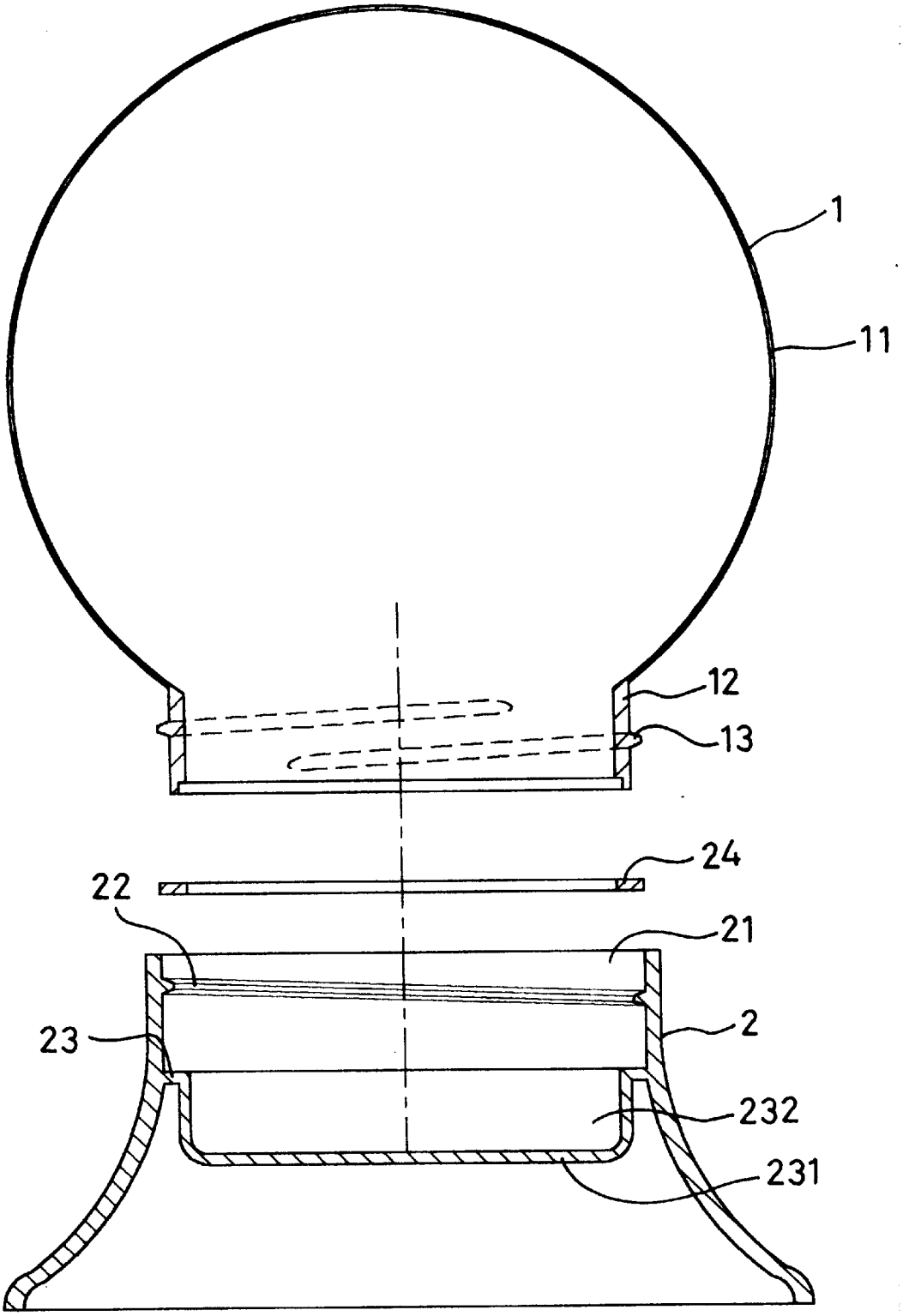
FIG. 1 is a sectional view of a liquid decoration container according to the present invention with parts thereof being detached.
Figure 2:
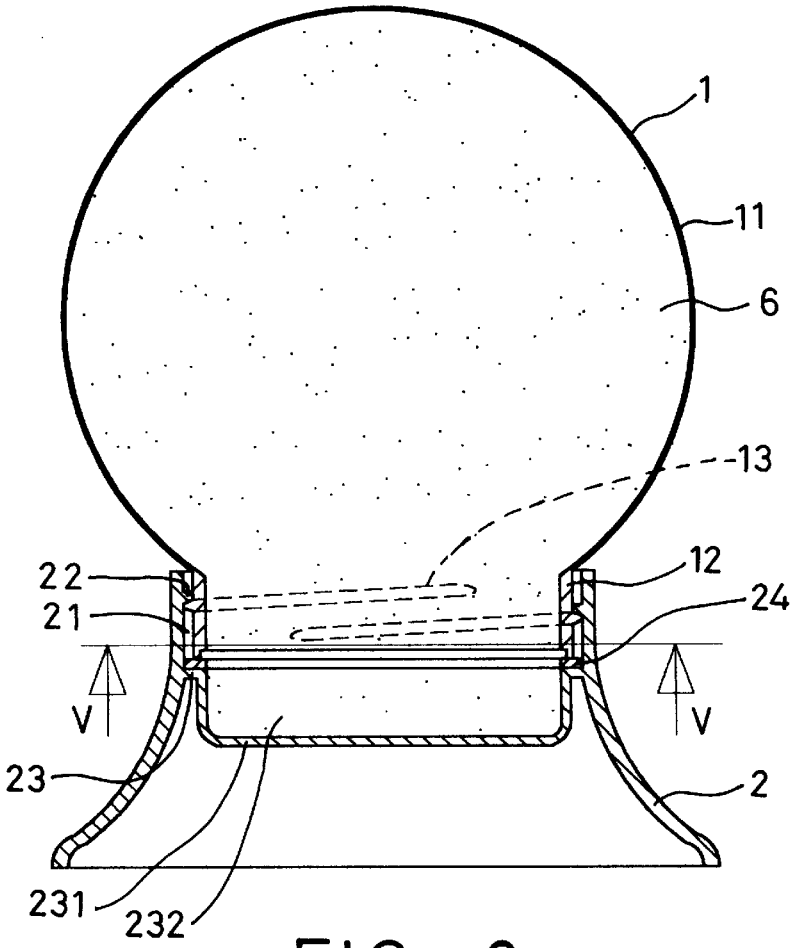
FIG. 2 is a rear sectional view of the liquid decoration container shown in FIG. 1 after assembling.
Figure 3:
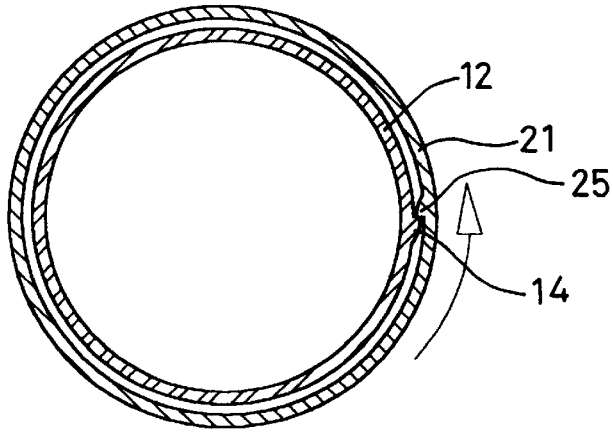
FIG. 3 is a sectional view along line V–V shown in FIG. 2.

Referring to FIGS. 1 to 3, a liquid decoration container of the present invention comprises an exhibition part 1 and a fitting part 2.

Wherein, the exhibition part is made from a hollow blank being fabricated first and then being blown to form a thin hollow casing 11 with any shape favorable for the user. The hollow casing 11 extends downward a thicker cylindrical casing 12 with an outer thread section 13. The casing 11 can be made of plastic material such as PET, . . . , and the like with toughness and impact resistance, and the wall thickness of the casing 11 can be controlled during blow forming with proper elasticity such that the casing 11 may not break in case of being pressed and can restore the original shape quickly.

The fitting part 2 is a base made of plastics with slight elasticity such as PP and an upper opening 21 at the top thereof corresponds to the cylindrical casing 12 and provides an inner thread section 22 for engaging with the outer thread section 13. Besides, the upper opening 21 at the lower inner wall thereof extends inward a ring plate 23 such that a lower rim of the cylindrical casing 12 can touch the ring plate 23 to perform a tight sealing and prevent the liquid 6 in the casing 11 from leakage as shown in FIG. 2 as soon as the cylindrical casing 12 engages with the opening 21. Furthermore, the ring plate 23 may extend a downward recess ring 231 to form an annular chamber 232, which is feasible for other embodiments. Moreover, the cylindrical casing 12 at the lower rim thereof may be arranged a packing ring 24 between the lower rim of the cylindrical casing 12 and the ring plate 23 to carry out an effect of complete liquid sealing.

Furthermore, in order to avoid the user turning the exhibition part 1 apart from the fitting part 2 himself and result in liquid leakage, an angle hook 14 is provided to protrude from a proper place on surface of the cylindrical casing 12 and a stopper 25 is provided to project from a proper place on the inner wall of the opening 21 such that a lock effect can be performed to prevent the cylindrical casing 12 from being turned inversely for loosening as soon as the angle hook 14 passes over the stopper 25.

Figure 4:
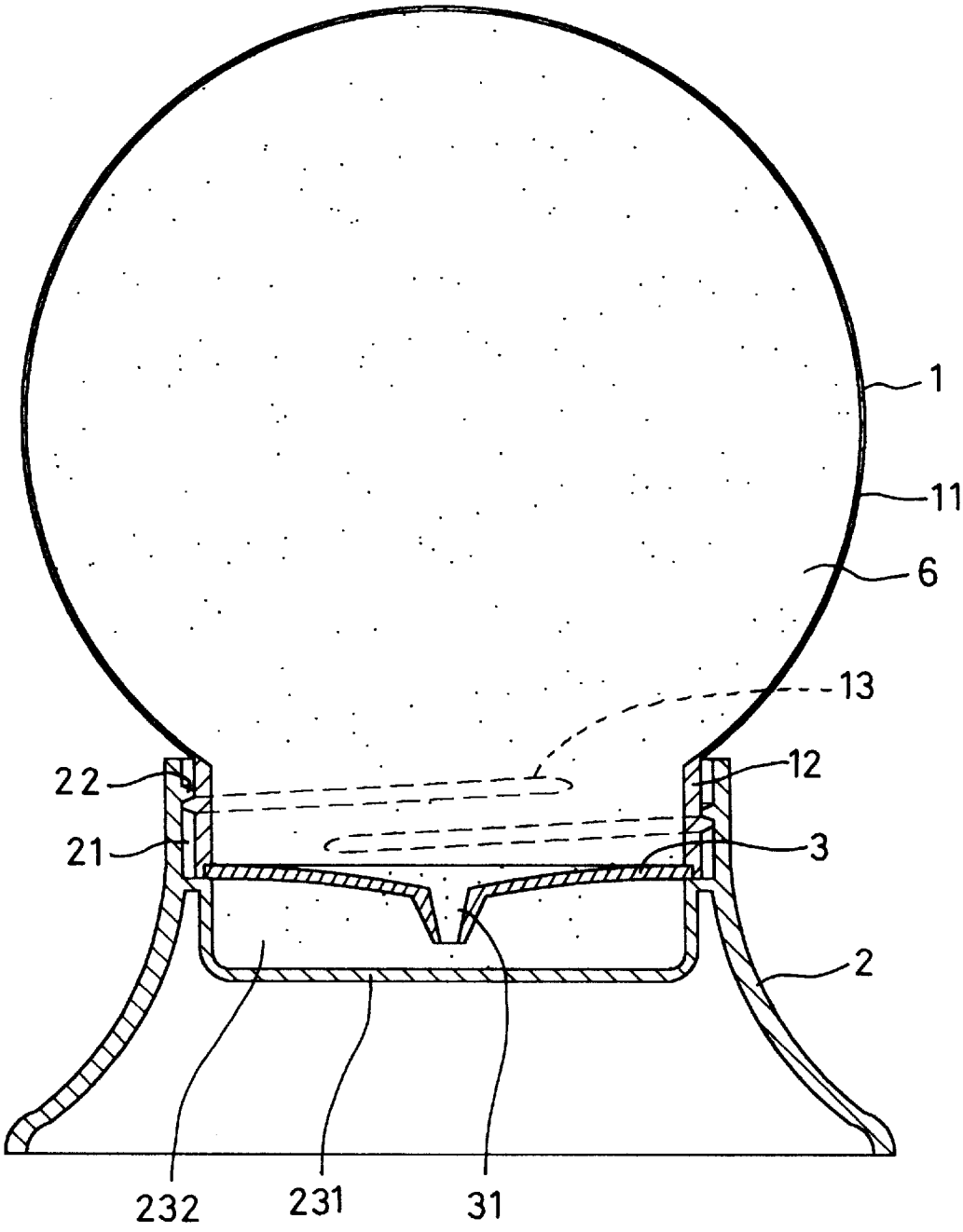
FIG. 4 is a sectional view illustrating a guide air plate being added in the liquid decoration container of the present invention.

In addition, in order to avoid the carelessness resulting from the control of manufacturing process disclosed in the prior art or the bubble problem resulting from the expansion caused by the heat and the contraction caused by the cold, an air guiding plate 3 is sandwiched between the cylindrical casing 12 and the ring plate 23. The air guiding plate 3 provides a slant surface with at least a guide hole 31. As shown in FIG. 4, the guide hole 31 is selectively disposed in accordance with the position of the doll. If the air bubbles in the hollow casing 11 are needed to remove, it is only necessary to inverse the liquid decoration container so as to allow the air bubbles moving along the inner wall of the hollow casing 11 and the air guiding plate 3. In this way, the air bubbles can pass through the guide hole 31 and stay in the annular chamber 232 finally. Thus, the air bubbles can be eliminated effectively and the step of vacuum suction in the manufacturing process can be left out without difficulty.

Figure 5:
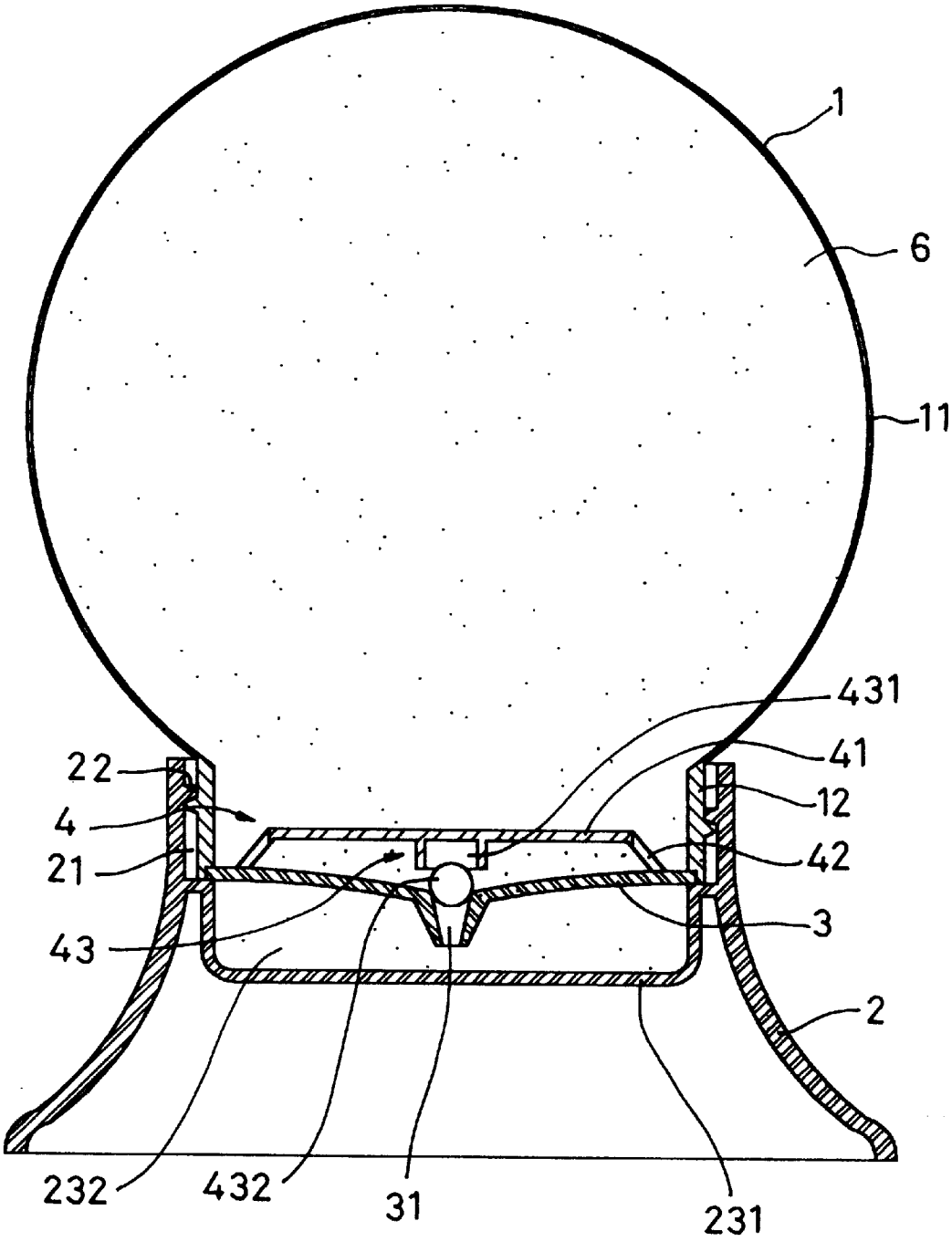
FIG. 5 is a sectional view illustrating a spacer being added in the liquid decoration container shown in FIG. 4.
Figure 6:
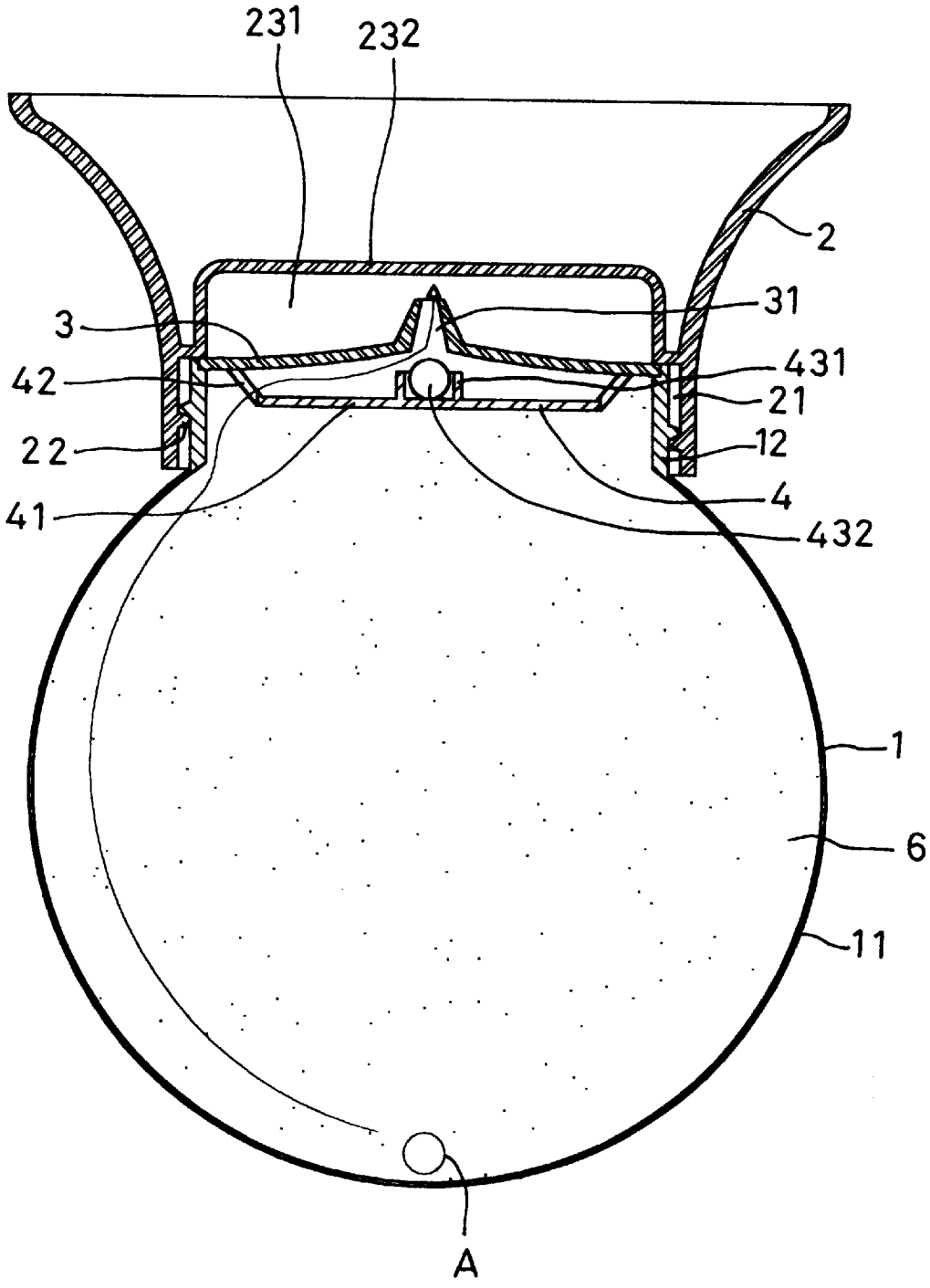
FIG. 6 is a reversed sectional view illustrating the route of moving bubbles in the liquid decoration container shown in FIG. 4.
Figure 7:
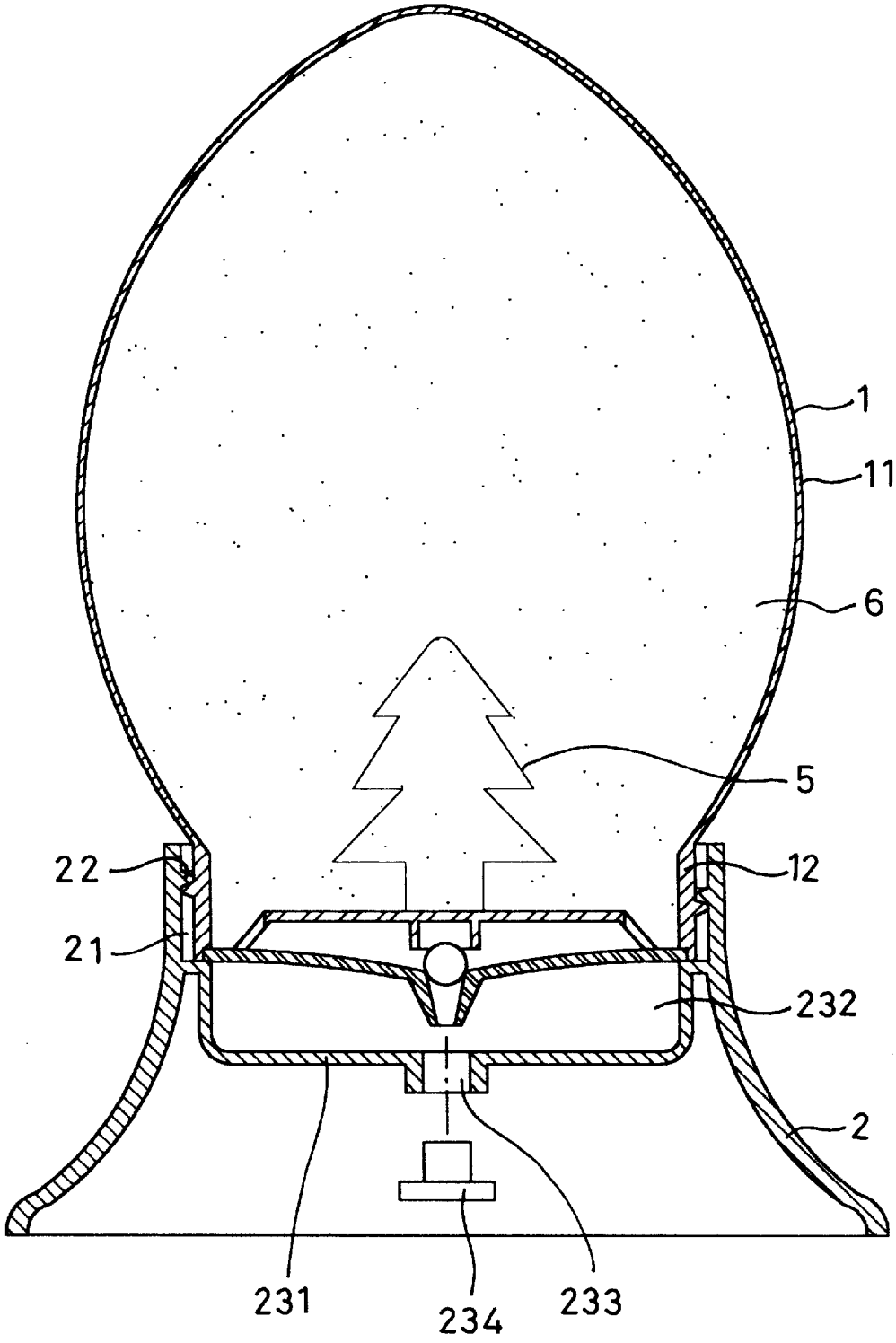
FIGS. 7 and 8 are sectional views illustrating an expansible doll being changed from one state to another state.

Referring to FIGS. 5 and 6, in order to enhance the good looking appearance and/or the effect of fun after shaking, an ordinary liquid decoration container provides a plurality of floating piece adornments or particle adornments such as metal pieces or snowflake grains in the exhibition part 1 in addition to the doll and the liquid. However, if the piece adornments or particle adornments are added in the embodiment shown in FIG. 4, they may pass through the guide hole 31 and enter the annular chamber 232. In order to avoid the occurrence of this situation, a spacer 4 is arranged to locate above the air guiding plate 3. The spacer 4 at the periphery thereof has a partition 41 with at least a slot 42 and at the bottom thereof has a close device 43 such as an orifice 431 with a plug 432 therein opposite to the guide hole 31. The plug 432 blocks the guide hole 31 under a normal state (that is, the liquid decoration container is put in a right position) to avoid the particle adornments or the piece adornments passing through the guide hole 31 as shown in FIG. 5. In case of the air bubbles A in the exhibition part 1 being removed, simply reverse the entire liquid decoration container as shown in FIG. 6 to let the bubbles A move along the innerwall of the hollow casing 11 to pass through the slot 42 and the guide hole 31 so as to stay in the annular chamber 232.

Figure 8:
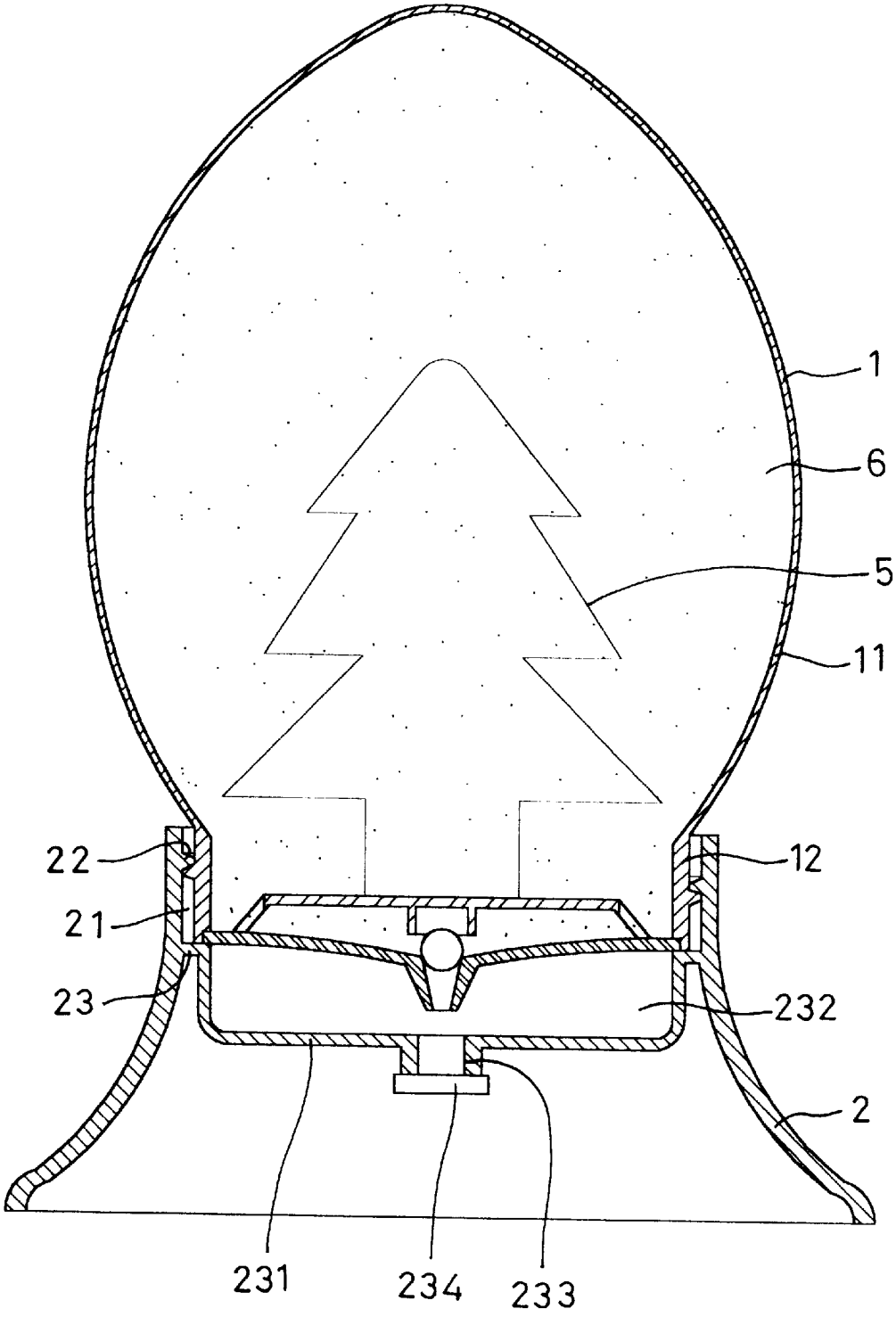

In fact, the doll in the conventional liquid decoration container mostly is static and made of high molecular with a property of water absorbing expansion such as foamed material or polymer. If the conventional doll stays in the water for a day, it can expand to a size greater than 50% time of the original size. However, it still has defects such as: (1) it is fragile after expansion so that it is not easy to be kept; and (2) it becomes soft after expansion so that it is easy to be eaten by children carelessly and it is not possible to be sold in certain territories such as Europe (a restriction of EN71). The doll 5 made of water absorbed expansible high molecular is placed in the decoration container in advance and the recess ring 231 provides an injection hole 233. The user can pour the liquid 6 into the exhibition part 1 through the injection hole 233 and an end plug 234 is adopted to close the injection hole 233. The doll 5 in the exhibition part 1 may expand gradually in a period of time due to absorbing the liquid as shown in FIG. 8. Hence, the doll enclosed in the exhibition part of the liquid decoration container is unable to be taken out and it is not possible to be eaten carelessly in addition to the function of amusement.

It can be understood from the preceding description that the liquid decoration container of the present invention is assembled by way of the specific property of material and the effect of sealing can be performed by way of the outer thread section on the cylindrical casing engaging with the inner thread section on the opening and the lower rim of the cylindrical casing touching the ring plate. Besides, the exhibition part of the present invention has the outer casing thereof is formed by way of blowing such that the shape thereof may not be limited to a spherical shape or symmetrical shape. Thus, a variety of shapes can be applied for the liquid decoration container. Furthermore, an air guiding plate is arranged between the exhibition part and the fitting part to guide the air bubbles into the annular chamber in the fitting part so as to omit the step of the vacuum suction during the manufacturing process. Also, the air guiding plate further avoids the bubbles resulting from the expansion caused by the heat and the contraction caused by the cold to increase the perfection rate of finished products. Moreover, a spacer with a close device is disposed above the air guiding plate to prevent the piece adornments and the particle adornments from entering the annular chamber. Therefore, it is not possible for a conventional liquid decoration container to reach the preceding features effectively.

While the invention has been described with reference to preferred embodiments thereof, it is to be understood that modifications or variations may be easily made without departing from the spirit of this invention, which is defined in the appended claims.

What is claimed is:

1. A liquid decoration container, comprising an exhibition part, formed by blowing a hollow blank as a hollow casing, the hollow casing having a downwardly extending cylindrical casing with an outer thread section; and a fitting part with an inner wall, and including a base with an upper opening corresponding to the cylindrical casing, the upper opening having an inner thread section, and a ring plate extending inwardly from an inner wall under the upper opening;

whereby, the liquid is filled in the exhibition part and a doll is arranged on the ring plate, the cylindrical casing engages the upper opening by way of the outer thread section fastening to the inner thread section; and a tight sealing is achieved as soon as a lower rim of the cylindrical casing touches the ring plate and, wherein the cylindrical casing has an angle hook and the upper opening has a stopper respectively to resist the cylindrical casing being turned inversely with respect to the upper opening as soon as the angle hook passes over the stopper.

2. The liquid decoration container according to claim 1, wherein the exhibition part is made of impact resistant plastic.

3. The liquid decoration container according to claim 1, wherein the ring plate at a periphery thereof has a packing ring so as to tightly fit with the lower rim of a cylindrical casing.

4. The liquid decoration container according to claim 1, wherein the ring plate has a downward recess ring to form an annular chamber.

5. The liquid decoration container according to claim 1, wherein the recess ring has an injection hole blocked by an end plug.

6. The liquid decoration container according to claim 1, further comprising an air guiding plate with a slant surface sandwiched between the cylindrical casing and the ring plate, the air guiding plate having a guide hole so that air bubbles can pass through the guide hole and be received in the annular chamber when the entire liquid decoration container is inverted.

7. The liquid decoration container according to claim 6, further comprising a spacer partition disposed above the air guiding plate with a periphery of the partition having a slot and a bottom of the partition having a closing device corresponding to the guide hole, the closing device blocking the guide hole to resist particles passing therethrough when the liquid decoration container is in an upright position; and wherein air bubbles can be received in the annular chamber through the slot and the guide hole when the liquid decoration container is inverted.

8. The liquid decoration container according to claim 7, wherein the partition of the spacer at a bottom thereof has an orifice corresponding to the guide hole and a plug ball with a specific weight greater than that of the liquid is moveably received in the orifice to block and open the guide hole.

9. The liquid decoration container according to claim 1, wherein the doll is made of high molecular material with water absorbing and expansion, properties.

10. A liquid decoration container, comprising an exhibition part formed by blowing a hollow blank as a hollow casing, the hollow, the hollow casing having a downwardly extending cylindrical casing with an outer thread section; and a fitting part with an inner wall, and including a base with an upper opening corresponding to the cylindrical casing, the upper opening having an inner thread section, and a ring plate extending inwardly from an inner wall under the upper opening;

whereby, the liquid is filled in the exhibition part and a doll is arranged on the ring plate, the cylindrical casing engages the upper opening by way of the outer thread section fastening to the inner thread section; and a tight sealing is achieved as soon as a lower rim of the cylindrical casing touches the ring plate, and further comprising an air guiding plate with a slant surface sandwiched between the cylindrical casing and the ring plate, the air guiding plate having a guide hole so that air bubbles can pass through the guide hole and be received in the annular chamber when the entire liquid decoration container is inverted.

11. The liquid decoration container according to claim 10, wherein the exhibition part is made of impact resistant plastic.

12. The liquid decoration container according to claim 10, wherein the ring plate at a periphery thereof has a packing ring so as to tightly fit with the lower rim of the cylindrical casing.

13. The liquid decoration container according to claim 10, wherein the ring plate has a downward recess ring to form an annular chamber.

14. The liquid decoration container according to claim 13, wherein the recess ring has an injection hole blocked by an end plug.

15. The liquid decoration container according to claim 10, further comprising a spacer partition disposed above the air guiding plate with a periphery of the partition having a slot and a bottom of the partition having a closing device corresponding to the guide hole; the closing device blocking the guide hole to resist particles passing therethrough when the liquid decoration container is in an upright position and wherein air bubbles can be received in the annular chamber through the slot and the guide hole when the liquid decoration container is inverted.

16. The liquid decoration container according to claim 15, wherein the partition of the spacer at a bottom thereof has an orifice corresponding to the guide hole and a plug ball with a specific weight greater than that of the liquid is moveably received in the orifice to block and open the guide hole.

17. The liquid decoration container according to claim 10, wherein the doll is made of high molecular material with water absorbing and expansion properties.

* * * * *